United States Patent [19]

Farrar

[11] Patent Number: 4,908,045

[45] Date of Patent: Mar. 13, 1990

[54] ENGINE CLEANING ADDITIVES FOR DIESEL FUEL

[75] Inventor: David H. Farrar, Scarborough, Canada

[73] Assignee: Velino Ventures, Inc., Thornhill, Canada

[21] Appl. No.: 289,622

[22] Filed: Dec. 23, 1988

[51] Int. Cl.[4] ..... C10L 1/14

[52] U.S. Cl. ..... 44/68; 44/63; 44/67

[58] Field of Search ..... 44/67, 68, 63

[56] References Cited

U.S. PATENT DOCUMENTS

| | | | |
|---|---|---|---|
| 3,294,685 | 12/1966 | Stevens | 44/68 |
| 3,341,311 | 9/1967 | Pedersen | 44/68 |
| 4,222,746 | 9/1980 | Sweeney | 44/68 |
| 4,389,220 | 6/1983 | Kracklauer | 44/68 |

FOREIGN PATENT DOCUMENTS

| | | | |
|---|---|---|---|
| 1028586 | 2/1986 | Japan | 44/68 |

OTHER PUBLICATIONS

National Research Counsel Final Report of the Motor Vehicle Nitrogen Oxide Standard Committee (1981).

Sarofim, S. F. and Flagam, R. C. "Prog. Energy Combust. Sci.", vol. 2, pp. 1–25, 1976.

*Primary Examiner*—William R. Dixon, Jr.

*Assistant Examiner*—James M. Hunter, Jr.

*Attorney, Agent, or Firm*—Basile and Hanlon

[57] ABSTRACT

A composition and method for reducing particulate emissions from a diesel engine without measurably increasing $NO_x$ emissions from the diesel engine comprises:

(i) burning in the diesel engine in excess air a fuel oil containing 0.01 ppm to 1 ppm of iron in a compound selected from the group consisting of ferrocene and its derivatives represented by the formula:

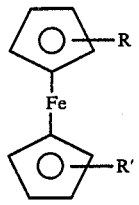

wherein each of R and R', independent of the other is hydrogen, alkyl, cycloalkyl, aryl and heterocyclic.

12 Claims, No Drawings

ENGINE CLEANING ADDITIVES FOR DIESEL FUEL

FIELD OF THE INVENTION

This invention relates to diesel engine fuel additives which are particularly suited for reducing particulate emissions from the diesel engine without necessarily increasing $NO_x$ emissions.

BACKGROUND OF THE INVENTION

Soot and other particulate emissions from diesel engines have been investigated for some time. It is generally understood that by modifying combustion chamber design, adjusting fuel-to-air ratio, turbo charging or super charging air to the engine as well as adjusting timing for injecting fuel to the combustion chamber, all have a significant impact on particulate emissions. Many of the above techniques are employed to reduce particulate emissions. However, a significant problem associated with the reduction of particulate emissions is the accompanying increase in $NO_x$ emissions.

With today's significant environmental concerns, every attempt is being made to reduce $NO_x$ emissions from internal combustion engines and in particular, diesel engines.

Elaborate studies have been conducted investigating combustion in diesel engines and the types of emissions therefrom. Henein discussed in his paper "Analysis of Pollutant Formation and Control and Fuel Economy in Diesel Engines", *Prog. Energy Combust. Sci.*, Vol 1, pp 165–207, 1976 many aspects of diesel engine design which contribute to unwanted emissions such as hydrocarbons, particulates and $NO_x$. Emission controls can be implemented by injection timing, addition of water, exhaust gas recirculation, fuel additives, turbo charging, compression ratio, pilot injection, fumigation, combustion chamber design and electronic control of the fuel injection.

The use of fuel additives in the control of soot and other emissions from engines has been investigated by Howard et al, in the article entitled "Soot Control by Fuel Additives", *Prog. Enerov Combust. Sci.* Vol 6, pp 263–276, 1980. It was found that the use of a barium based compound was very effective as a smoke suppressant. It was thought to have a strong future as an additive for diesel fuels. Other suggested additives were of the non-metallic type which were also considered to be somewhat effective, but the preferred choice of metal type of additive was the barium based compound.

It is generally understood in the art that, with the operation of diesel engines, $NO_x$ emissions from the engine increase when engine operation is modified or additives are used to decrease soot, particulates, smoke and opacity, all of which are synonymous with carbon emissions from the engine. The National Research Council reported in "$NO_x$ Emission Controls for Heavy Duty Vehicles: Toward Meeting a 1986 Standard", National Academy Press (1981) that a 50% reduction in $NO_x$ emissions from a diesel engine would probably be accompanied by a 30% to 100% increase in particulates. Furthermore, such reduction in $NO_x$ emissions would also be accompanied by a 50% plus increase in hydrocarbon (HC) emissions and a 7% or more penalty in fuel consumption. Conversely, any attempt to reduce particulates in the emissions of the engine results in an increase in the $NO_x$ emissions. Historically there has been a perceived trade-off between the level of allowable $NO_x$ emissions and the consequent increased particulate emissions. No one has been able to decouple this relationship between the amount of $NO_x$ emissions and the corresponding resultant particulates in the exhaust of the diesel engine.

U.S. Pat. No. 3,341,311 reports that combustion of liquid hydrocarbon fuels, including diesel fuels, may be improved by the use of dicyclopentadienyl iron at concentrations in the range of 4 ppm to 3000 ppm based on iron in the organic compound. It is noted that such dicyclopentadienyl iron compounds materially improve the ignition and combustion characteristics of fuels, decreasing their tendency to form soot in the exhaust gases and solid carbonaceous deposits in the engine. The preferred concentration of the dicyclopentadienyl iron compound is used in fuel oils in the range of 20 ppm to 300 ppm of iron. The improvements in combustion, when using these additives in fuel oils, were tested in a standard ASTM lamp test employing an ASTM number 27 burner. The tests were directed at evaluating soot emissions from the wick flame. Tests were also conducted in a burner to determine carbon buildup. At a concentration of 4 ppm of the iron containing compound, no visible carbon was observed in the exhaust gases whereas in non-additive situations, the exhaust gases contained material amounts of visible carbon. No consideration, however, was given in these tests nor in the discussion of the invention on the impact that the use of ferrocene and related compounds in fuel oils would have on $NO_x$ emissions. However, in view of the above-noted references, those skilled in the art expected that any improvement in combustion to reduce the particulates in the exhaust would correspondingly increase $NO_x$ emissions.

SUMMARY OF THE INVENTION

Quite surprisingly, according to this invention, a concentration range has been discovered for the use of ferrocene and its derivatives in a diesel fuel which significantly decreases particulate emissions and quite unexpectedly does not measurably increase $NO_x$ emissions.

According to an aspect of the invention, the method for reducing particulate emissions from a diesel engine without measurably increasing $NO_x$ emissions from the diesel engine comprises:

(i) burning in said diesel engine in excess air, a fuel oil containing 0.01 ppm to 1 ppm of iron in a compound selected from the group consisting of ferrocene and its derivatives represented by the formula:

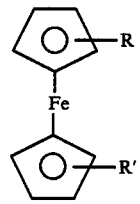

wherein each of R and R', independent of the other is hydrogen, alkyl, cycloalkyl, aryl or heterocyclic.

According to another aspect of the invention, a fuel composition is provided for use in an internal combustion diesel engine. The composition comprises:

(i) a fuel oil ii 0.01 ppm to 1 ppm of iron in a copound selected from the group consisting of ferrocene and its derivatives represented by the formula:

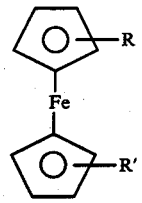

wherein each of R and R', independent of the other is hydrogen, alkyl, cycloalkyl, aryl or heterocyclic.

DETAILED DESCRIPTION OF THE PREFERRED EMBODIMENTS

Although considerable work has been devoted to improving combustion efficiency in diesel engines, because of the broad range of applications and power demands, it is difficult if not impossible to ensure that the diesel engine is operating during various power settings at peak efficiency with complete combustion of the fuel. Hence with diesel engines, there is the unsightly emission of black smoke when the engine is not operating at peak efficiency in terms of fuel-to-air ratio. The additive, according to this invention, is therefore quite useful in reducing the unsightly emissions from diesel engines, while at the same time, providing the unexpected advantage in improving the overall air quality from an environmental standpoint. The additive, according to this invention, is environmentally safe and does not result in the production of any undesirable toxic materials. The additive, according to this invention, which is incorporated in standard diesel fuels, is a compound selected from the group consisting of ferrocene and its derivatives represented by the formula:

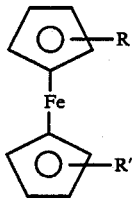

wherein each of R and R', independent of the other is hydrogen, alkyl, cycloalkyl, aryl or heterocyclic.

In the above formula, the term "alkyl" refers to an alkyl group branched or straight chain of 1 to 10 carbon atoms, such as methyl, ethyl, propyl, n-butyl, hexyl, or heptyl. The term "cycloalkyl" refers to a lower cycloalkyl group of 3 to 7 carbon atoms, such as cyclopentadyl or cyclohexyl. The term "aryl" refers to an organic radical derived from an aromatic compound by the removal of one hydrogen atom. Such compounds include phenyl and substituted phenyl such as lower alkyl and substituted phenyl. These compounds include tolyl, ethylphenyl, triethylphenyl, halophenyl, such as chlorophenyl, or nitrophenyl. The term "heterocyclic" refers to pyrrol, pyridyl, furfuryl and the like. The aryl or heterocyclic group generally contains up to about 15 carbon atoms.

Dicyclopentadienyl iron is commonly referred to as "ferrocene". Hence the compounds of the above formula I are considered to be ferrocene and its derivatives. The preferred compounds of formula I include ferrocene(dicyclopentadienyl) iron, di(methylcyclopentadienyl) iron, di(ethylcyclopentadienyl) iron, methylferrocene, ethylferrocene, n-butylferrocene, dihexylferrocene, phenylferrocene, m-tolylferrocene, didecylferrocene, dicyclohexferrocene and dicyclopentylferrocene.

The above additives may be either incorporated directly into the fuel oil before dispensing to automobiles, trucks and other forms of vehicles and watercraft. Alternatively, the additive of this invention may be incorporated in a suitable organic carrier to provide a concentrate which is either admixed with the fuel oil at a later time, or injected into the fuel oil for the combustion chamber during burning of the fuel oil in the engine, or in the delivery of the fuel oil to the injector for the diesel engine. Suitable organic carriers are of a type in which the selected ferrocene compound is soluble. Preferably, the carrier liquid has a high flash point and is of a viscosity at operating temperatures to enable injection through injector nozzles of the diesel engine. The preferred flash point of the carrier liquid is in excess of 74° F. and has a boiling point in excess of 95° F. The viscosity of the carrier is normally 50 centipoises, or less at 20° C. and is preferably in the range of 0.3 to 3.0 centipoises at 20° C. Suitable organic carrier liquids, that is solvents, are either of the aromatic or hydrocarbon type. Aromatic solvents include xylenes, toluenes, and Solvesol 100 TM (commercially available from Imperial Oil) which is a mixture of benzene and naphthalenes having a flash point in the range of 100° F. Suitable hydrocarbons include alcohols, such as hexanol or octanol. Other hydrocarbons include petroleum spirits and the like. The solvents of this nature have a functional flash point with low viscosity which are stable and in which the selected additive is soluble and results in non-toxic byproducts when combusted.

It is appreciated that the concentrate composition including the additive may include a variety of commercial dyes to provide a distinctive color for the composition and distinguish it from other additives used in conjunction with diesel engines.

It is generally accepted that diesel fuels are fairly well categorized world-wide. The various parameters for defining characteristic features of diesel fuels are well understood by those skilled in the art. The following Table 1 identifies characteristics of diesel fuels which are important with respect to the evaluation of this invention.

TABLE I

| DIESEL FUEL CHARACTERISTICS | |
|---|---|
| Heating value (Btu/pound, dry) | 19,400 |
| Carbon (weight %, dry) | 87.20 |
| Hydrogen (weight %, dry) | 12.50 |
| Nitrogen (weight %, dry) | 0.02 |
| Sulfur (weight %, dry) | 0.26 |
| Oxygen (weight %, dry) | 0.01 |
| Ash (weight %, dry) | 0.01 |
| Conradson Carbon (weight %, dry) | 0.05 |
| Vanadium (ppm, weight) | 5 |
| Viscosity (centistokes) | 3.2 |
| API Gravity | 26 (min.) |
| Distillation Point | 90% (min.) at 360° C. |
| Cetane Number | 48 (min.) |

The concentration of the additive of this invention in the fuel oil, which is about to be burned, is in the range of 0.01 ppm to 1 ppm of iron in the selected ferrocene compound. It is appreciated that, should the source of additive be in conjunction with a suitable carrier, the amount of concentrate used is such to achieve these in use concentrations in the fuel oil. These use concentration ranges are considerably below what was perceived as necessary; i.e., prior use concentrations of ferrocene in fuel oils in excess of 4 ppm and preferably in excess 20 ppm.

The concentration of ferrocene then used in this invention is four times less at the maximum end of this inventive concentration compared to the lowest permissible amount of ferrocene used in the prior art techniques.

In accordance with this invention, use of ferrocene and its derivatives in fuel oils for combustion in a diesel engine results in reduced CO emissions, reduced hydrocarbon emissions, reduced particulate carbon, reduced particulate emissions, an increase in combustion efficiency and no measurable effect or increase on $NO_x$ emissions. Depending upon the concentration of ferrocene used in the fuel oil, one can expect a:

(1) reduction in CO emissions in the range of 5% to 15%;
(2) reduction in hydrocarbon emissions in the range of 2% to 15%;
(3) reduction in particulate carbon in the range of 5% to 40%;
(4) reduction in particulate emissions in the range of 20% to 50%; and
(5) increase combustion efficiency in the range of 0.2% to 0.5%.

The method and fuel composition, according to this invention as it applies to diesel engines, significantly reduces soot formation in an effective manner using concentration ranges actives which are at least four times less to achieve significant benefits and accomplish these features in a manner totally unpredictable based on prior understandings. Modern studies have conclusively shown that the formation of carbon containing particulates will always occur in the normal operation of diesel engines, although, these particulates in emissrons can be controlled somewhat by altering either physiochemical diesel fuel properties; i.e., use of various additives, at concentration ranges of 100 ppm or greater, or by altering the diesel engine operating designs. It is understood, however, that alteration of these physiochemical diesel fuel properties or diesel engine operating designs invariably results in increased $NO_x$ emissions. The fuel properties most often altered by physiochemical techniques include Cetane number, volatility, pour point and specific gravity. The engine condition most altered is its peak temperature which can be lowered by such technologies as exhaust gas recirculation or water injection. It is therefore quite surprising that, in accordance with this invention, such reduction in hydrocarbon emissions and particulate emissions can be so significant without any accompanying increase in $NO_x$ emissions. Although the mechanism of this invention is not fully understood with respect to the manner in which the additive reduces particulates in the emissions without increasing $NO_x$ emissions, it is apparent that, by use of such low concentrations, according to this invention, of ferrocene and its derivatives, one can achieve this decoupling or dissociation of the long understood relationship that, in reducing particulates in diesel engine exhaust, there is a corresponding increase in $NO_x$ emissions. Hence the method and fuel composition of this invention provides a fresh efficacious, previously undisclosed result by the use of the known ferrocene compounds and its derivatives in the manner described by this invention. The unexpected advantages of this invention are verified by the following Examples which are understood to apply to a variety of internal combustion diesel operation engines, but are in no way considered to be limiting to the scope of the invention as defined in the appended claims.

In the following Examples, compositions of this invention were tested in a diesel engine which was preconditioned to a steady-state condition using neat; i.e., undoctored fuel of the type defined in Table 1. For each composition tested, the engine was allowed to equilibrate for about one hour before measuring combustion performance and emissions in the engine exhaust. All test fuels were fired under the following standardized conditions using a high performance turbocharged, heavy-duty stationary diesel engine-Mitsubishi Model S6U-PTA. The engine was a four stroke, six cylinder, 4300 cubc inch diesel engine rated at 1400 brake horsepower at 1200 rpm under full load. At this level of operation, the engine consumed approximately 8,000,000 BTUs per hour of conventional diesel fuel. Although the tests were conducted on this stationary engine, it is appreciated that the advantages of this invention are equally applicable to mobile engines.

The test fuels were fired under the following standardized conditions:

(1) engine output: 1180 horsepower;
(2) engine load 85%;
(3) engine speed 1200 rpm;
(4) firing rate 8,000,000 BTUs per hour;
(5) excess air 250%;
(6) engine exhaust temperature 840° F.;
(7) no combustion air preheating.

In the following tests, specific combustion performance characteristics measured were significant if outside of the following ranges:

$CO_2$ ±2%;
CO ±3%
$O_2$ ±2%
$NO_x$ ±2%
hydrocarbons ±2%
particulate loading ±5%
carbon content ±0.5%

Combustion efficiency is based on the extent to which elemental carbon in the fuel is oxidized to $CO_2$ upon combustion.

The fuel oil, as treated in accordance with this invention, had the active ingredient mixed into the fuel oil by use of a carrier 2-ethylhexanol with dicyclopentadienyl iron.

The following Table 2 summarizes the results of the additive ferrocene at two distinct concentrations:

(i) a ratio of ferrocene to fuel oil of 1:1500 which is a concentration of 0.04 ppm of iron in ferrocene;
(ii) a ratio of ferrocene to fuel oil of 1:900 which is a concentration of 0.08 ppm of iron in ferrocene.

TABLE 2

RESULTS OF EVALUATION OF DIESEL FUELS OF THIS INVENTION

| | Agent Admixed into Diesel Fuel | | | |
|---|---|---|---|---|
| | 2-Ethyl Hexanol Carrier | Ferrocene Additive | 2-Ethyl Hexanol Carrier | Ferrocene Additive |
| Agent/Diesel Fuel Ratio (Volume) | 1:1500 | 1:1500 | 1:900 | 1:900 |
| Iron Content of Agent in Concentrate (ppm, weight) | 0 | 68 | 0 | 68 |
| Carbonex Iron added to Diesel Fuel (ppm, weight) | 0.0 | 0.04 | 0 | 0.08 |
| Engine Exhaust Temperature (°F.) | 843 | 832 | 843 | 839 |
| $O_2$ (%, volume, as-measured) | 12.25 | 12.25 | 12.25 | 12.25 |
| $CO_2$ (%, volume, as-measured) | 6.5 | 6.5 | 6.5 | 6.5 |
| $NO_X$ (grams/brake horsepower-hour, air-free) | 7.96 | 8.01 | 7.90 | 8.02 |
| CO (grams/brake horsepower-hour, air-free) | 0.82 | 0.76 | 0.80 | 0.72 |
| HC (grams/brake horsepower-hour, air-free) | 0.42 | 0.41 | 0.44 | 0.40 |
| $RO_X$ (grams/brake horsepower-hour air-free) | 0.07 | 0.05 | 0.07 | 0.04 |
| Carbon in Particulates (%, weight) | 23 | 20 | 23 | 16 |
| Combustion Efficiency (%) | 99.5 | 99.7 | 99.5 | 99.9 |

From the standpoint of percentage variations in the unexpected and important aspect of ignition results, in accordance with this invention, they can be summarized as follows:

The 1:1500 volumetric addition to diesel fuel of the concentrate containing ferrocene at 68 ppm iron, which is equivalent to using 0.04 ppm of iron in the fuel:

Reduced CO emissions 7%
Reduced HC emissions 3%
Reduced particulate carbon 13%
Reduced particulate emissions 29%
Increased combustion efficiency 0.2%, and
Had no effect on $NO_x$ emissions The 1:900 volumetric addition to diesel fuel of the concentrate containing ferrocene at 68 ppm iron, which is equivalent to using 0.08 ppm iron in the fuel:

Reduced CO emissions 10%
Reduced HC emissions 9%
Reduced particulate carbon 26%
Reduced particulate emissions 43%
Increased combustion efficiency 0.4%, and
Had no effect on $NO_x$ emissions From the above results, it is clear that the use of the additive in concentration ranges, according to this invention, is superior to all other known types of diesel particulate control technologies, because with this invention there is no increase in $NO_x$ emissions or diminished fuel economy. The ferrocene additive of this invention is competitive with all other types of chemical additives for diesel particulate reduction, not only from a price standpoint, but also from an environmental standpoint because the additive does not in any way produce byproducts which are toxic to the environment. Furthermore, the use of additives according to this invention do not have any effect on the Cetane number, nor the pour point of the fuel oil.

Although preferred embodiments of the invention have been described herein in detail, it will be understood by those skilled in the art that variations may be made thereto without departing from the spirit of the invention or the scope of the appended claims.

I claim:

1. A method for reducing particulate emissions from a diesel engine without measurably increasing $NO_x$ emissions from said diesel engine, said method comprising:

(i) burning a fuel oil in said diesel engine in the presence of excess air, the fuel oil containing a compound selected from the group consisting of ferrocene, and derivatives of ferrocene represented by

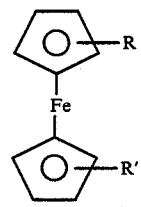

wherein each R and R', independent of the other is selected from the group consisting of hydrogen, alkyl, cycloalkyl, aryl or heterocyclic functional groups, said compound present in an amount between 0.01 ppm and 1.0 ppm based on iron molecules present in said compound.

2. A method of claim 1 wherein said selected compound is premixed with said fuel oil.

3. A method of claim 1 wherein said selected compound is injected into said fuel oil at said concentration levels prior to burning said fuel oil in said engine.

4. A method of claim 1 wherein excess air delivered to said engine is in the range of 200% to 300% excess air.

5. A method of claim 3, wherein said selected compound is admixed with an organic carrier liquid in which said selected compound is an injectable liquid at operating temperatures.

6. A method of claim 1 wherein said selected compound is dicyclopentadienyl iron.

7. For use in an internal combustion diesel engine, a fuel composition capable of burning with reduced particulate emissions while maintaining the $NO_x$ emissions at an essentially stable level, the fuel composition comprising:

(i) a fuel oil; and (ii) a compound selected from the group consisting of ferrocene and derivatives of ferrocene represented by the formula:

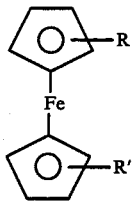

wherein each of R and R', independent of the other, is selected from the group consisting of hydrogen, alkyl, cycloalkyl, aryl or heterocyclic functional groups, said compound present in an amount between 0.01 ppm and 1.0 ppm based on iron molecules present in said compound.

8. A fuel composition of claim 7 wherein said fuel oil has the following characteristics:

(i) an API gravity from about 30 to about 46, and (ii) an end distillation point of at least 480° F.

9. A fuel composition of claim 8 wherein said selected compound is dicyclopentadienyl iron.

10. A fuel composition of claim 9 wherein said compound is dispersed in said fuel oil by a dispersing agent.

11. A method of claim 1, wherein the fuel oil contains 0.04 ppm to 0.08 ppm of iron in the selected compound.

12. A fuel composition of claim 7, wherein there is 0.04 ppm to 0.08 ppm of iron in the selected compound.

* * * * *